United States Patent [19]

Vonlanthen

[11] Patent Number: 4,924,686

[45] Date of Patent: May 15, 1990

[54] CONTACT DEVICE FOR TRANSMITTING ELECTRICAL SIGNALS BETWEEN A LOCK AND KEY IN A CYLINDER LOCK

[75] Inventor: Benno Vonlanthen, Zollikofen, Switzerland

[73] Assignee: R. Berchtold AG, Zollikofen, Switzerland

[21] Appl. No.: 279,155

[22] PCT Filed: Feb. 2, 1988

[86] PCT No.: PCT/CH88/00026

§ 371 Date: Oct. 4, 1988

§ 102(e) Date: Oct. 4, 1988

[87] PCT Pub. No.: WO88/05854

PCT Pub. Date: Aug. 11, 1988

[30] Foreign Application Priority Data

Feb. 9, 1987 [CH] Switzerland ..... 455/87
Jan. 7, 1988 [CH] Switzerland ..... 39/88

[51] Int. Cl.[5] ..... E05B 49/00

[52] U.S. Cl. ..... 70/277; 70/278; 70/279; 70/395; 70/409; 70/413

[58] Field of Search ..... 70/277–279, 70/393, 395, 408, 409, 413, DIG. 46

[56] References Cited

U.S. PATENT DOCUMENTS 3,347,072 10/1967 Rose ..... 70/277
3,550,410 12/1970 Toepfer ..... 70/364
3,787,812 1/1974 Armstrong ..... 70/278 X
4,326,125 4/1982 Flies ..... 70/277 X
4,393,672 7/1983 Gelhard ..... 70/277
4,458,512 7/1984 Gelhard ..... 70/277
4,663,952 5/1987 Gelhard ..... 70/278
4,712,398 12/1987 Clarkson et al. ..... 70/278 X

FOREIGN PATENT DOCUMENTS 2055951 3/1981 United Kingdom .
2187227 9/1987 United Kingdom ..... 70/277

*Primary Examiner*—Gary L. Smith
*Assistant Examiner*—Suzanne L. Dino
*Attorney, Agent, or Firm*—Tarolli, Sundheim & Covell

[57] ABSTRACT

A flat turning key (2) has a mechanically coded key bit (7) and an additional electronic information carrier (9), as well as a contact part (12) with contact points (8) located at the rear part of the key bit (7). In the cylinder lock (1) are arranged further electronic components (41) connected with a current source that cooperate with the information carrier (9) via the contact points (8) on the key (2). In the region of the contact part (12) of the cylinder lock (1) contact elements (55) arranged in a guiding element (50) establish an electric contact between the key (2) and the lock (1) when the key (2) is turned in the lock (1). The contact elements (55), the electronic components (41) and a microswitch (42) are connected with a common support or printed circuit-board (14) and detachably secured together with the guiding element (50) in the stator housing (3).

13 Claims, 6 Drawing Sheets

CONTACT DEVICE FOR TRANSMITTING ELECTRICAL SIGNALS BETWEEN A LOCK AND KEY IN A CYLINDER LOCK

BACKGROUND OF THE INVENTION

1. Technical Field

The invention relates to a contact device for transmitting electrical signals between a lock and key in a cylinder lock with a stator housing. A rotor is arranged therein with mechanical holding devices and a key channel having a portion in which contact elements for the signal transmission are present, as well as a key with an integrated electronic information carrier. On the key barb in a portion beside the mechanical codings, contact points are arranged.

2. Description of the Prior Art

Cylinder locks of this kind are used where the security of the known, purely mechanical cylinder locks no longer satisfy the requirements, and additional electronic security means are arranged both on the key and on the lock. Setting the key to such cylinder locks with at least one memory element which contains a magnetic or electronic code, is known. In this lock is a corresponding reading device which may consist of a simple electronic reading unit or one or more microprocessors. For transmitting the stored data from the key to the lock, optical, inductive or mechanical contact elements may be used. The key and cylinder lock in such locking devices are exposed to many disturbing influences, such as soiling, deformation, strong magnetic fields, etc., and there are often disturbances in use with such locks and keys set with added electronic elements. This occurs especially where the transmission of the stored data takes place through optical or inductive contact elements.

Keys and locks in which electronic elements with security information are combined with mechanical holding devices or codings have only been in widespread use quite recently. It has been found that the use of mechanical contacts assures the highest security in the transmission of signals. Because of the high degree of miniaturization of the known mechanical cylinder locks, and the needed long life of contact parts between lock and key, the shaping of contact elements in locks presents extremely great difficulties. Most of the contact elements known today do not satisfy in cylinder locks. Such a cylinder lock with security in cylinder locks. Such a cylinder lock with the respective key is known from German Patent No. 3,245,681. In the key described there, incisions are arranged on the key barb in which pin holding devices engage when the key is inserted in the lock. These pin holding devices are supported in a rotor which can rotate in the stator housing of the cylinder lock. If the key incisions agree with the penetration depth of the pin holding devices, the mechanical blocking between rotor and stator housing is removed. In addition to this mechanical coding or holding, at the end of the key barb is arranged an electronic security system. For this, there is present on the key barb a data carrying ring, for example, in the form of a magnetic strip or with a light or electrooptical point or strip screening. In the lock is arranged, in the portion of the data carrier on the key, a reading head which, without contact, produces the contact for the passage of information between key and lock. This contact or reading unit decodes the data contained on the key and checks it for agreement with the data stored in the lock.

If there is agreement, then through an electromagnet and a blocking element, the rotary movement of the rotor is released, and the lock can be opened. In this arrangement, the number of possible locking variations, through the superimposing of the electronic system on the mechanical, is greatly increased. But the system described here is extremely prone to disturbance since foreign particles may collect on the data carrier on the key barb. The transmission of data between key and lock is disturbed or even prevented. Also, the data stored on the data carrier on the key barb may be changed through strong magnetic fields or other external influences, purposely or involuntarily. In this way, this lock-and-key system greatly loses in security and is extremely prone to disturbances. Disturbances in the electronic portion have the effect that the lock, even with agreement of the mechanical coding between key and lock, can no longer be opened since the rotor remains blocked electromechanically. If this blocking is released by bridging over the electronic system, the security of the lock is limited to that of a purely mechanical coded lock and key system.

A lock and key system is known from German Patent No. 3,006,128 A1, in which the information is transmitted from the key to the lock through a mechanical contact device. In this device, an electronic circuit is placed in the key barb portion of the key, which contains among other things, memory units for electronic codings. On the key barb are arranged contact rings which are connected with the electronic circuit. The receiving housing for the key contains slide contacts which, with the key completely inserted, lie against the contact surfaces on the key barb. Beside the key housing is arranged a lock which can be actuated electromagnetically and which is controlled by a locking control such as a microprocessor for example. With agreement of the data stored in the electronics of the key with the allowing conditions in the control of the lock, this opens the electromagnetic lock. It is apparent that the mechanical contact arrangement in the form of a coaxial catch plug, like that shown here, can be used only with difficulty on a mechanical cylinder lock with the known miniature construction. Coaxial plugs of this kind are bulky and do not meet the requirements as to long life and security, as demanded in mechanical cylinder locks.

From U.S. Pat. No. 4,379,966 can be seen another contact system with slide contacts. Here the contact springs are arranged on an elastic bearing plate which also has conductor paths. This elastic plate is placed around a part of the stator of the lock, and is fastened into the desired position with the aid of complicated parts pushed one into another. This lock also has no mechanical blocking elements. Rather, electric signals can only be provided by a data carrying key. It is apparent that the contact device cannot be built into a known mechanical cylinder lock, since the solution shown is too complicated and too bulky and takes up the whole circumference of the stator.

SUMMARY OF THE INVENTION

The problem of the present invention is to provide a mechanical contact device between lock and key, which is so small that it can easily be built into a known mechanical cylinder lock system. This can be developed to a mechanical-electronic cylinder lock which is arranged in only a portion of the circumference of the rotor and takes up only a portion of the circumference of the stator. Trouble-free contacting between key and lock is assured over a long life, and despite the great miniaturization, a security of operation is attained which corresponds to that of the known mechanical lock and key systems.

This problem is solved by the fact that on the stator housing, in the portion of the contact element, a mantle segment is cut out. This cut-out frees a portion of the mantle of the rotor and the portion of the key channel which serves to receive the key barb portion with the contact points. In the cut-out of the stator housing and within the protective sheath, a guide element of electric insulating material is arranged for contact elements which are fastened to a bearing plate. The contact element engaging in the guide element consist of pairs of slide springs. The spring elements are placed in the freed portion of the rotor mantle, on both sides of the axis, tangential with and free of contact with the rotor mantle. The bearing plate with the contact elements and the guide element are set radially into the stator cut-out and enclosed by the protective sheath.

According to the invention, the contact device on the lock includes an arc shaped guide element on which a conductor plate and at least two pairs of mechanical contact elements are arranged side-by-side. The contact elements, in the installed condition, are in the portion of the lock. With the key inserted, the contact points arranged on the barb of the key are positioned. The contact elements are connected directly with the conductor plate, giving a very compact construction in the portion of the guide element. Since the guide element has the form of a ring segment of the stator housing, the unit formed by the guide element with the contact elements and the conductor plate can be set radially into the stator housing. This facilitates the installation and removal of the contact device with at least a part of the respective electronic elements on the lock. Also, contact elements and conductor plate can be removed without having to remove rotatable mechanical elements of the lock, especially the rotor. This has the further advantage that the mechanical part of the lock and key system can be prepared and tested without the contact device and electronic elements having to be installed in the lock.

One preferred form of execution of the invention is distinguished by the fact that the bearing plate has a reinforced conductor plate, and the connection parts of the conductor elements are connected with conductors on the plate. It has also proved advantageous that the spring elements of the contact elements are separated in the middle portion and have two contact points.

The contact elements designed as spring elements each with a pair of legs forming a slide spring, are fastened through the connection part, and fastened to the conductor plate into their position in the lock or on the guide element. The distance between the individual contact elements corresponds to the distance of the contact points on the key barb. One slide spring element of each contact element forms, on both sides of the connection part, a tangent to the outer diameter of the rotor without touching the rotor. This is assured by the free guiding of the spring portion of the slide spring elements in the guide element, and the shape of the spring portion. Through the fastening of the slide spring elements to the conductor plate, on the one hand, and the freely movable guiding of the spring portion in the guide element, the contact elements arranged one after the other in the direction of the axis of the lock are fastened definitely into their position, but at the same time, take up only a portion of the circumference of the rotor. The arrangement and shape of the two slide spring elements of each contact element assure also the exact amount of the contact forces, as well as high security and useful life. Each of the slide spring elements has several spring portions. Since the slide spring elements are exactly positioned and fastened into their mutual position, they can be designed broader and additionally separated. The separation takes place by means of a lengthwise slide or the arrangement of two spring elements. In this way there results per contact point on the key barb, two contact points to each slide spring element. This represents an increase of the contact security factor in the second power. Also, geometrical inequalities in form in the transition portion between contact points on key and lock are better excluded, from which there is an additional improvement of the transition contact.

Another preferred form of execution consists of the fact that the slide springs are arranged in the portion of a maximum of 90° on both sides of the pull-out position of the key channel. Since the pull-out position of the key channel is identical with that position in which the key can be inserted in the lock, it follows that the transmission of data between key and lock is possible during a maximum of 90° rotation of the key in both directions. Through the symmetrical design of the slide spring elements on both sides of the key channel, the production of an electric contact between lock and key, in both rotation directions, is assured. Another improvement according to the invention is that the rotor, in the portion of the slide spring elements, has on its outer mantle a circular groove, and there is a space between the slide spring elements and the bottom of the groove. Another preferred form of execution consists of the fact that with the key inserted fully into the key channel of the rotor, the narrow side with the contact points of the key stands out above the bottom of the groove on the rotor, and during a part of the rotary movement of the rotor touches the slide spring element.

Another improvement of the contacting device can be obtained by the fact that a microswitch is arranged on the bearing plate. This microswitch is switched into the electric current circuit, and has a switch pin as a switching element of which the end projects into the key channel. In a further embodiment of the invention, the microswitch includes a foil key which is integrated into the conductor plate. Foil keyboards are used at present in the operating fields of machine controls. The combination with a switch pin makes possible integration into the network of electric conductors on the conductor plate and thus the bringing together of the important electric parts on the conductor or bearing plate.

The subject of the invention may be used in a simple way for the turning on of the electric source. The switch pin of the microswitch cooperates with the key in the zone of the rear three-fourths of the length of the key barb extending from the beginning of the contact part to the end of the key. Thus, the microswitch is activated before the key has been completely inserted in the lock. This has the advantage that batteries, for example, by breakdown of the passivation layer in lithium batteries and other electronic elements, are activated before the signal transmission between key and lock begins. According to the starting inertia of the electronic system, the microswitch is arranged more toward the first fourth of the key barb or toward the contact part.

Another advantageous form of execution of the invention is distinguished by the fact that on the two contact surfaces between the stator housing and the guide element on the stator housing, and/or on the guide element, parallel guide grooves are arranged running about perpendicular to the axis of the rotor, and the free ends of the slide spring elements of the contact elements are supported movable in these grooves. With this arrangement, the individual slide spring elements are supported at both ends. This makes possible an exact regulation of spring force in the middle portion of the slide spring element and give a high mechanical security. Guide element and contact elements can be set radially, in a simple way, into the stator housing without need of involving the mechanical portion of the lock.

In another preferred form of execution, the free ends of the slide spring elements or the contact elements are provided with an electric insulating layer and/or the guide grooves are provided with an electric insulating layer. The insulation layers used may be of various known materials, such as Teflon for example.

According to another preferred form of execution of the invention, the contact elements have in the portion of the axis of the lock, a connection part. The two slide spring elements proceed form this connection part, and bend into the portion away from the connection part, and lead back toward the connection part. Each slide spring element is formed to two spring portions running about parallel. The spring portion with the free spring element ends is directed toward the rotor and arranged free of contact with the rotor. The free end of each slide spring element is supported against a middle support of the guide element.

By the connection part, the slide spring elements are fastened to the conductor plate and the spring portions are movable freely in the guides of the guide element. The contact elements arranged in succession in the direction of the axis of the lock are definitely fastened in their position, but take up at the same time only a portion of the circumference of the rotor. This arrangement and shaping of the two slide spring elements of each contact element assures the exact regulation of the contact forces as well as great security and a long life. Each of the slide spring elements has several spring portions. At the clamping point, the bending point along the two spring portions running about parallel can spring inward. In this way, the load of the material in the individual bending points is reduced. The bending amounts are to 160° at a minimum and 200° at a maximum.

The contacting device according to the invention can be designed in miniaturized construction. It can easily be combined with the known mechanical lock and key systems, and integrated into a corresponding cylinder lock. The security of the contacting between lock and key is greatly increased by the proposed device, as compared with the known systems, so that there is a great improvement of the operation security of the mechanical-electronic lock and key system. The assembling of the corresponding lock units is very simple since the contacting device includes no rotating parts. Also, the exchange of defective containing devices with the respective bearing plate parts is possible without intervention in the mechanical portion of the lock.

BRIEF DESCRIPTION OF THE DRAWINGS

The invention will be explained in detail below from examples of execution, with reference to the attached drawings in which.

DESCRIPTION OF PREFERRED EMBODIMENTS

Figure 1:
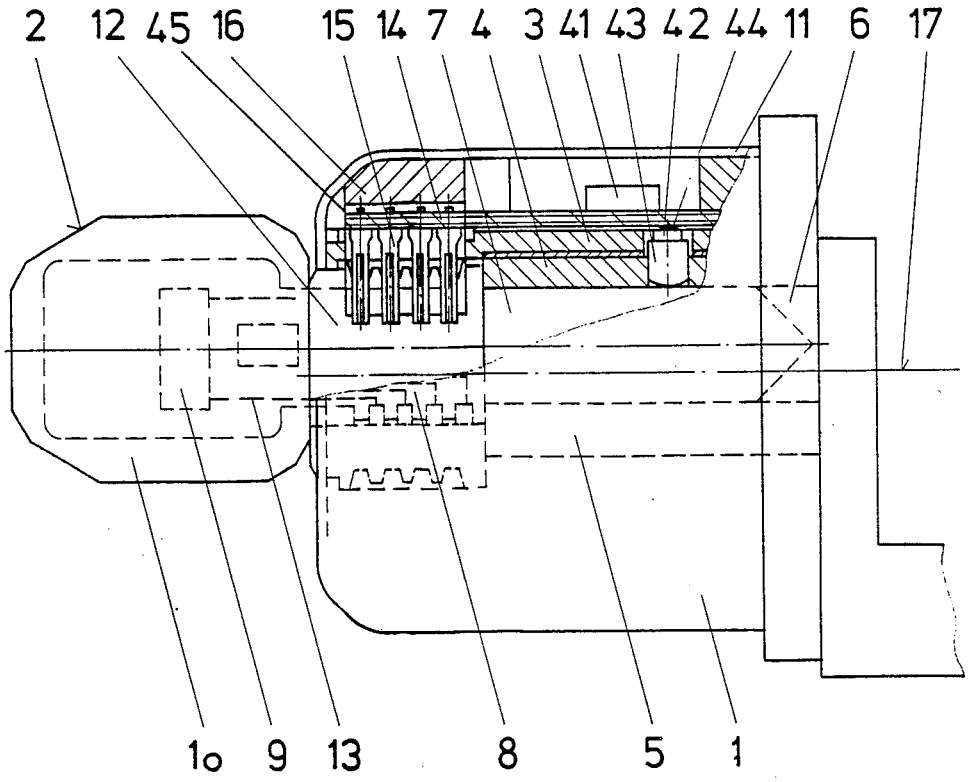
FIG. 1 shows schematically a cylinder lock with key inserted, and a partial sectional view of the portion of the contacting device with a guide element according to FIG. 3.
Figure 3:
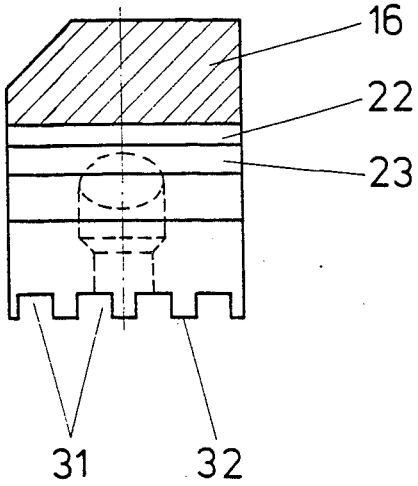
FIG. 3 is a longitudinal sectional view on a larger scale of the guide element of the contacting device in the lock according to FIGS. 1 and 2.
Figure 2:
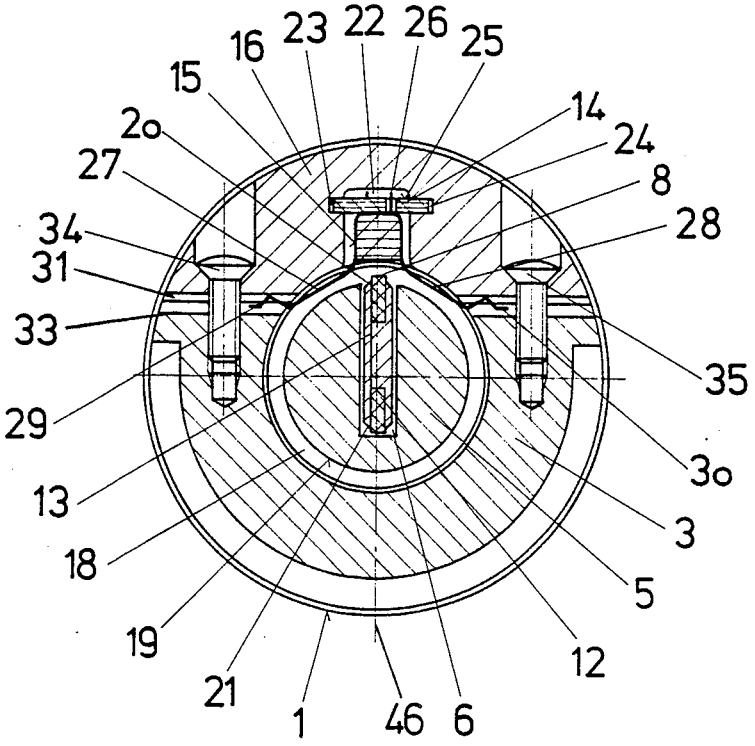
FIG. 2 is a cross-sectional view through the cylinder lock according to FIG. 1, showing the portion of the contacting device.
Figure 4:
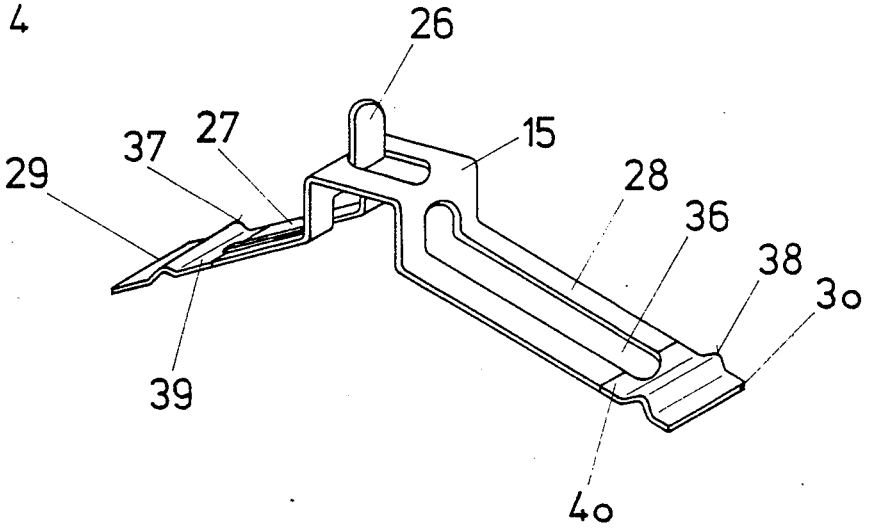
FIG. 4 shows on a larger scale a contacting element with two slide springs fitting the guide element according to FIG. 3.
Figure 5:
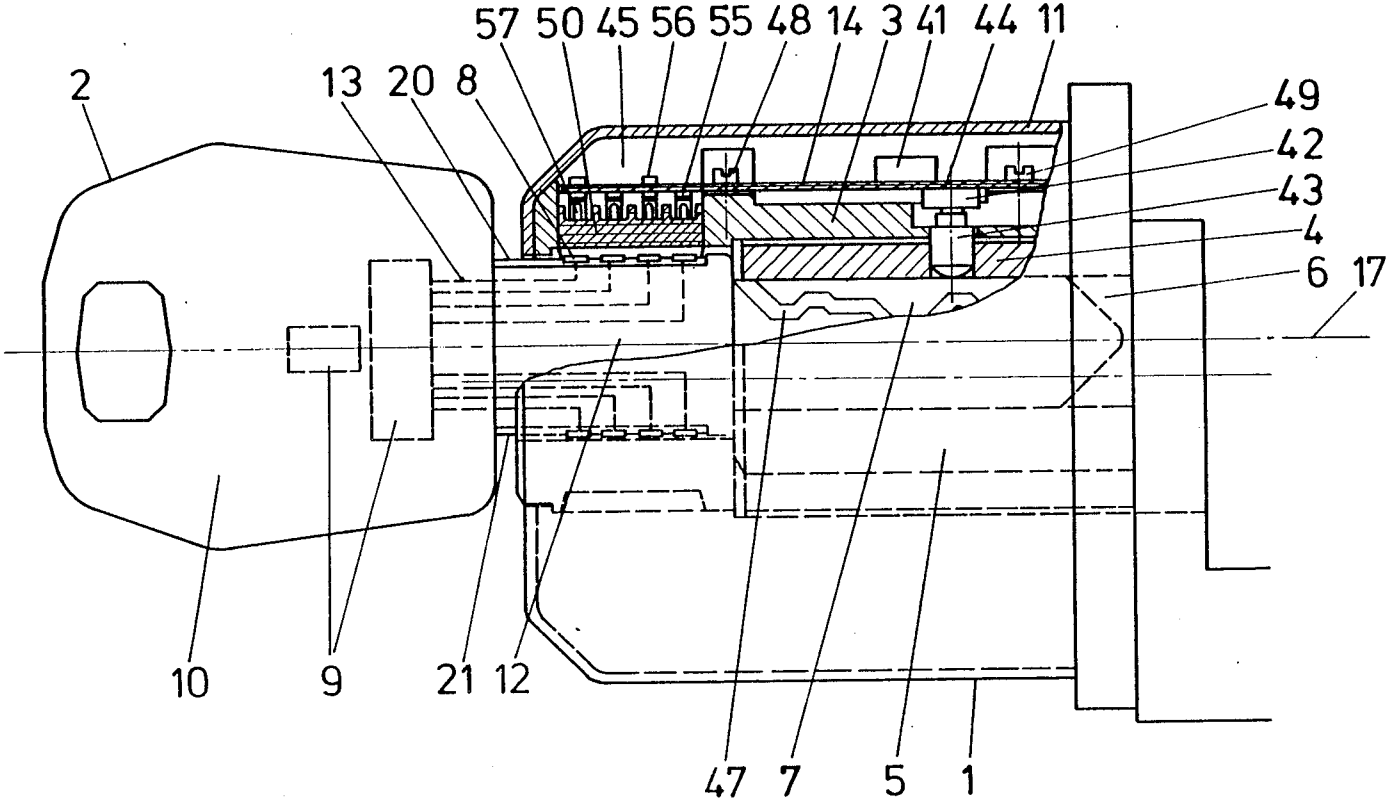
FIG. 5 shows schematically a cylinder lock with key inserted and a partial section in the portion of the contact device with a guide element according to FIG. 7.

A cylinder lock 1, represented in FIG. 1, is a component of a double cylinder lock. The cylinder lock 1 is provided with known mechanical holding devices and additionally with an electronic security device. The cylinder lock 1 includes mainly a stator 4, a stator housing 3 and a rotor 5, as shown in FIG. 5. The whole lock is surrounded by an outer mantle (casing) 11. Other details of the lock and key unit represented in FIG. 1 are shown in FIGS. 2, 3 and 4. A flat key 2, inserted in the cylinder lock 1, includes a key barb portion (stem) 10 and a key barb (notch) 7. In the rear zone of the key barb 7 is arranged a contact part 12 on which are contact points 8. These contact points 8 are connected through electrical conductors 13 with an electronic information carrier 9. In the example shown, the electronic information carrier 9 includes a microprocessor, and/or a use-oriented integrated circuit (ASIC) with one or more memory elements which can process and receive electronic information. These electronic elements of the information carrier 9 are built into the key barb portion 10 of the key 2. In the rotor 5 of the cylinder lock 1 in the portion of the key barb 7 are arranged mechanical holding devices, not shown. The mechanical holding devices cooperate with mechanical coding on the key barb 1. This mechanical joining can be carried out in the known way, according to European patent No. 8,310. The mechanical portion of the cylinder lock is freed when the proper key 2 is pushed all the way into the key channel 6. In the lower portion of the cylinder lock is also a built-in electromagnetic blocking device which acts between rotor 5 and stator 4. This electromagnetic blocking device also includes a bearing plate 14 to which are fastened the contact elements 15 in the form of slide springs. On the bearing plate 14 which is formed on a conductor plate are arranged also electronic elements 41 connected through electrical conductors with the contact elements 15. These electronic elements 41 include, according to the kind of design of the lock, simple electronic parts, memory elements or one or more microprocessors. For the operation of the electronic system, there is also a current source, not shown. The microprocessor of the electronic element 41 in the cylinder lock 1 reads the data from the electronic information carrier 9 on the key 2, and stores as needed, new data in this information carrier 9. If the electronic information carrier 9 on the key 2 contains the right data, then the electromagnetic block, not shown but known per se, in the cylinder lock is released. The lock can be opened by rotation of the rotor 5, if at the same time, the mechanical codings on the key barb 7 are correct. The transmission of data from key 2 to lock 1, and vice versa, takes place through the slide spring elements 27, 28 in the cylinder lock 1 and through the contact points 8 arranged on the contact part 12 of the key barb 7. In the example shown, four contact elements 15, and correspondingly four contact points 8, on each narrow side 20, 21 of the key barb 7, are present. Both the individual contact elements 15 and the individual contact points 8 are insulated from each other and are connected through the integrated electric conductor with the corresponding electronic elements 9 and 41. The bearing or conductor plate 14 and the contact elements 15 are arranged in a guide element 16 which includes a circle segment. The circle element is pushed perpendicular to the axis 17 of the lock into the mantle segment opening 45 on the stator housing 3, and is detachably connected with this housing 3.

On the bearing or conductor plate 14 is arranged a microswitch 42. This microswitch 42 includes a foil key 44 integrated into the conductor plate 14 which opens or closes the current circuit in the cylinder lock 1. The foil key 44 is activated by means of the key barb 7 which, on pushing into the key channel 6, acts on a switch pin 43. The switch pin 43 is supported in the stator 4 and is also part of the microswitch 42.

The section through the cylinder lock in the portion of the contact device, in FIG. 2, shows the stator housing 3, the rotor 5 with the key channel 6, the contact part 12 of the key barb 7 and the guide element 16. This guide element 16 has an opening 22 with side grooves 23, 24, into which is fastened the bearer or conductor plate 14. On the conductor plate 14, at least on the upper side, are electrical conductors 25. These, in the form of printed circuits, make the connections to the microswitch 42 and to the connection points. On the underside of the bearing or conductor plate 14 are arranged the contact elements 15. Each contact element 15 has a connection part 26 which passes through the bearing or conductor plate 14, and is connected on its upper surface with the electrical conductors 25, for example, by soldering. Moreover, each contact element 15 includes two slide spring elements 27, 28, of which the ends 29, 30 are guided in the guide element 16.

For the guiding of the ends 29, 30 of the slide spring elements 27, 28, the guide element 16 is provided, as shown in FIG. 3, with guide grooves 31. These guide grooves 31 are arranged in the contact surface 32 of the guide element 16 and run perpendicular to the axis of the lock 17. The guide element 16 lies by the surface 32 on the contact surface 33 of the stator housing 3 and is joined detachably to the latter with screws 34, 35. The guide element 16 has the form of a circular segment and is set into the corresponding opening 45 on the stator housing 3.

The contact element 15, according to FIG. 4, has a pair of slide springs 27, 28. Both slide spring elements 27 and 28 are provided in the middle with a lengthwise slot 36 and is divided, over the contact portion, into two independently movable parts. The ends 29 and 30 of the slide spring elements 27 and 28 are bent and form slide portions 37 and 38. These slide portions 37 and 38 are provided with an insulating layer 39 and 40. In the example shown, Teflon is used. These coatings 39 and 40 act to insulate the slide spring elements 27, 28 of the contact element 15 from the guide element 16 and at the same time assure the sliding of the slide spring ends 29, 30 in the guide grooves 31. In the middle portion, the contact element 15 is shaped so that it can be set into the opening 22 on the guide element 16, and so as to allow the forming of the connection part from this. To increase the insulation and assurance of sliding, the guide grooves 31 and the contact surface 33 are also provided with corresponding coatings of Teflon.

As shown in FIG. 2, the contact point 8 on the key 2 are arranged on its narrow sides 20 and 21. The contact points 8 are designed symmetrical on both narrow sides, and are connected in the same way through electrical conductors 13 with the electronic element 9 in the key 2. In the portion of the contact device there is formed on the rotor 5 a circular groove 18, by which in this portion a ring gap results between the rotor 5, the stator housing 3 and the bearing body 16. In the upper portion of this ring groove 18 are positioned the slide spring elements 27, 28 of the contact portion 15. Their position is determined, on the one hand, by the fastening of the connection part 26 to the bearing plate 14, and on the other hand, by the forced guiding of the ends 29, 30 in the guide groove 31. The slide spring elements 27, 28 form on both sides of the connection part 26 or the key channel 6, in the pulled-out position, tangents to the outer diameter of the rotor 5, while they are arranged free of contact with the mantle of the rotor 5. There is thus an interspace between the bottom 19 of the groove on the rotor 5 and the two slide springs 27, 28 of the contact element 15. The dimensions of the contact part 12 with the contact points 8 on the key barb 7 and the groove 18 on the rotor 5 are so chosen that the narrow side 20 of the contact part 12 stands out above the bottom of the groove 19. This projection is such that in the example shown, the contact points 8 on the narrow side 20, with a rotation of the rotor 5, one of the slide springs 27 or 28 touch and deflect these so far out of their rest position that the desired contact force is reached. In this way, the electric connection is made between the electronic elements 9, 41 in the lock 1 and in the key 2, and data can be transmitted so long as the contact points 8 are connected with one of the slide springs 27, 28 of the contact element 15.

The cylinder lock 1 shown in FIG. 5 is identical in most parts with the lock in FIG. 1, and is a component of a double cylinder lock which is provided with known mechanical holding devices and additionally with an electronic security device. The cylinder lock 1 includes, here also, mainly of the stator 4, the stator housing 3 and the rotor 5, more clearly shown in FIG. 6, and is surrounded by an outer mantle (casing). The flat key 2, inserted in the cylinder lock 1, includes the key barb portion 10 and the key barb 7. In the rear zone of the key barb 7 is arranged a contact part 12 on which contact points 8 are located. These contact points 8 are connected through electrical conductors 13 with an electronic information carrier 9. As in the example according to FIG. 1, the electronic information carrier 9 includes a microprocessor and/or a use-oriented integrated circuit (ASIC) with one or more memory elements, which process and can receive electronic information. These electronic elements of the information carrier 9 are built into the key barb portion 10 of the key 2. In the rotor 5 of the cylinder lock 1 are arranged, in the portion of the key barb 7, mechanical holding devices (not shown) which cooperate with mechanical codings 47 on the key barb 7. This mechanical joining also is carried out in the known way according to European Patent No. 8,310. The mechanical portion of the cylinder lock 1 is released when the right key 2 is pushed all the way into the key channel 6. An electromagnetic blocking device is also built into the lower portion of the cylinder lock 1. This acts between the rotor 5 and the stator 4. This electromagnetic blocking device includes the bearing plate 14 to which are fastened the contact elements 55 with the slide springs 57, 58. On the bearing plate 14 which is formed of a conductor plate are arranged the electronic element 4 connected through electric lines with the connection parts 56 on the contact element 55. These electronic elements 41 each include, according to the kind of lock design, simple electronic parts, memory elements or one or more microprocessors. A current source, not shown, is also present for the operation of the electronic system. The microprocessor of the electronic element 41 in the cylinder lock 1 reads the data from the electronic information carrier 9 on the key 2 and stores new data in this information carrier as needed. If the electronic information carrier 9 on the key 2 contains the right data, the electromagnetic block, not shown but known per se, in the cylinder lock 1 is released, and the lock can be opened by turning the rotor 5, if at the same time, the mechanical codings on the key barb 7 are correct. The transmission of data from the key 2 to the lock 1, and vice versa, takes place through the slide spring elements 57, 58 of the contact element 55 in the cylinder lock 1 and through the contact points 8 arranged on the contact part 12 of the key barb 7. In the example shown, four contact elements 55 and, correspondingly, four contact points 8 on each narrow side 20, 21 of the key barb 7 are present. Both the individual contact elements 55 and the individual contact points 8 are insulated from each other and joined through the integrated electric conductor with the corresponding electronic elements 9 and 41.

A guide element 50 is set radially into the mantle segment 45 cut out of the stator housing 3. This guide element 50 is arc-shaped and has of electric insulating material such as plastic, for example, and has guide slots for the slide spring elements 57, 56 of the contact element 55. The bearing or conductor plate 14 of and the contact element 55 are fastened by means of screws 48, 49 to the stator housing 3. The bearing plate 14 with the contact elements 55, like the guide element 50, is pushed into the stator housing 3 at right angles to the lock axis 17, and is detachably connected with this housing 3.

On the bearing or conductor plate 14 is arranged a microswitch. This microswitch 42 includes a foil key 44 integrated into the conductor plate 14. The microswitch turns on or off the current circuit in the cylinder lock 1. The foil key 44 is activated by means of the key barb 7 which, in pushing into the key channel 6, acts on a switch pin 43. The switch pin 43 is supported in the stator 4 and is also part of the microswitch 42.

Figure 6:
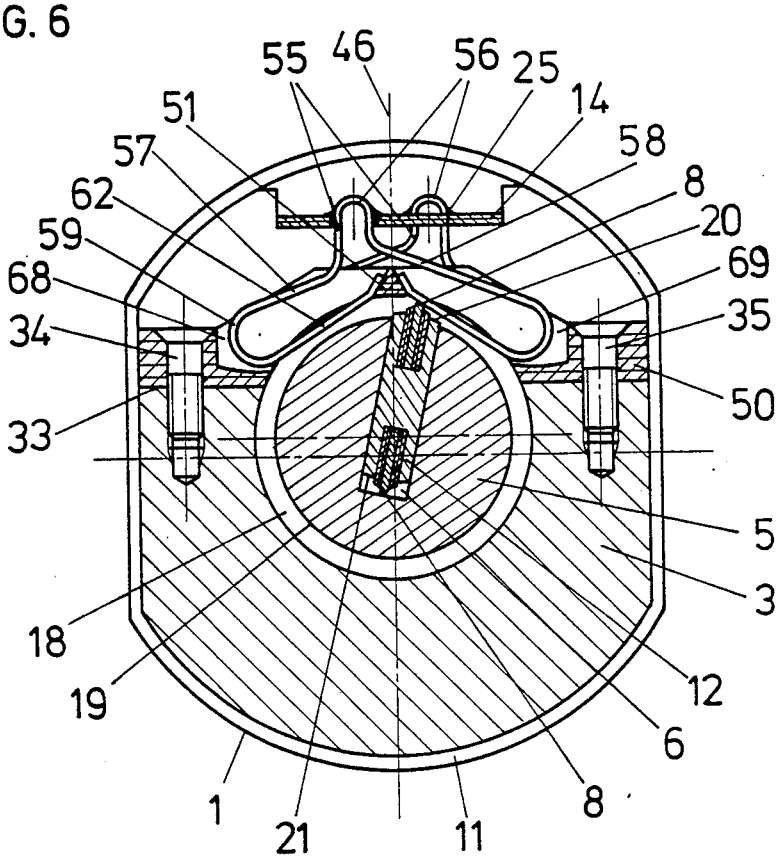
FIG. 6 is a cross sectional view through the cylinder lock according to FIG. 5, showing the portion of the contact device.

The section through the cylinder lock 1, shown as an example in FIG. 5, in the portion of the contact device according to FIG. 6, shows the stator housing 3, the rotor 5 with the key channel 6, the contact part 12 of the key barb 7, and the guide element 50. In FIG. 6, the rotor 5 is rotated with the key by about 15° from the pull-out position. The guide element 50 lies against surfaces 33 on the stator housing 3 and is fastened with screws 34, 35. On the bearing or conductor plate 14, at least on the upper side, are electrical conductors 25. These, in the form of printed circuits, make the connections to the microswitch 42 and to other electronic connection points. On the underside of the bearer plate 14 are arranged the contact elements 55 with the slide springs 57, 58. Each contact element 55 has a connection part 56 which passes through the bearing or conductor plate 14 and is connected on its upper surface with the electrical conductors 25, for example, by soldering. Moreover, the pairs of slide springs 57, 58 belonging to each contact element are guided into the openings 68, 69 in the guide element 50.

Figure 7:
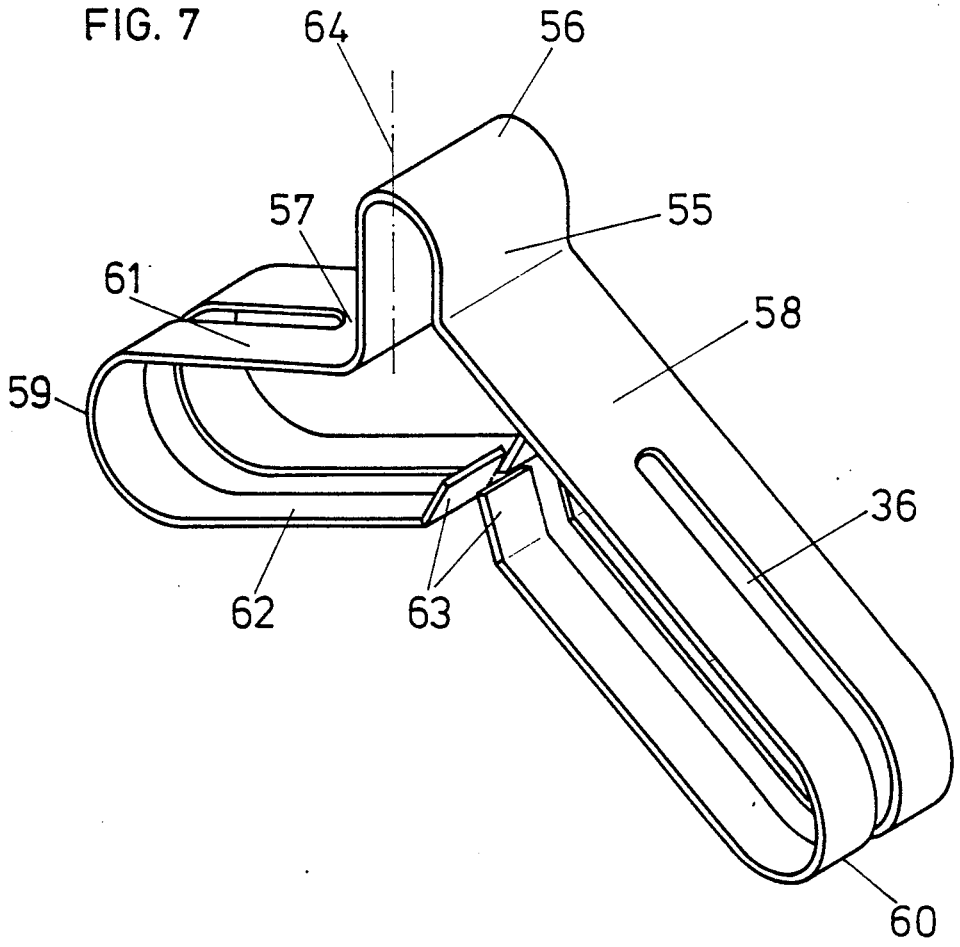
FIG. 7 shows on a larger scale a contact element like that used in FIG. 6 with the two slide spring elements.

According to FIG. 7, each of the contact elements 55, according to FIG. 5 for example, has a connection part 57 and a pair of slide springs 57, 58, which are arranged on both sides of the connection part 56. In the example shown, the slide springs 57, 58 each include, with the axis 64, an angle of about 60°. The angle is chosen so that the springs 57, 58, in the built-in condition run tangent to the circle of rotation formed by the contact points 8 on the key 2. The individual slide springs 57, 58 each consist of an outer spring portion 61 and an inner spring portion 62. These two portions 61 and 62 are formed of one piece since the springs are bent by about 180° at the bending points 59 and 60. The two spring portions 61 and 62 run about parallel after the bending. In the built-in condition, the ends 63 of the inner spring portion 62 lie against the middle support 51 of the guide element 50 by which the desired position of the spring elements 61 and 62 is given. The contact elements 55 are made of known conductor materials. To increase the security of contact, each slide spring element 57, 58 has a longitudinal slot 36. In this way, the result at the spring portion 62 is that two contact points are movable independently of each other.

Figure 8:
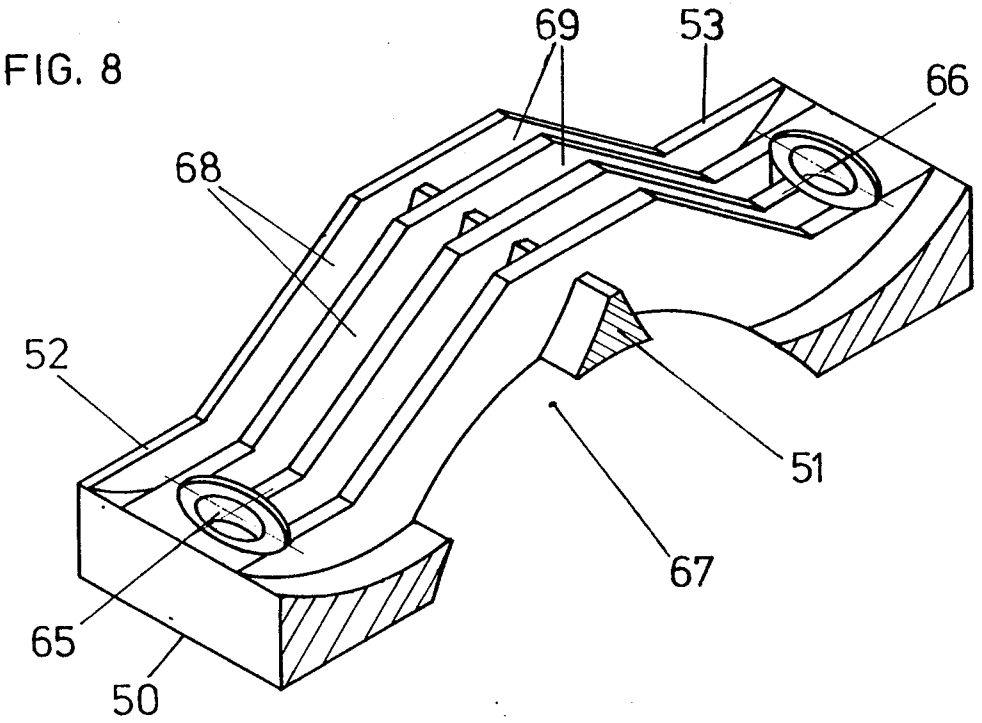
FIG. 8 shows a perspective view of the guide element of the contact element according to FIG. 1.

In FIG. 8 is shown the guide element 50 which is used in the example according to FIG. 5. Here, the front part of the wall is cut away. This guide element 50 includes a good electric insulating plastic with good slide properties. The guide element 50 has the form of a mantle segment and is designed in bridge form. The two side parts 52 and 53 are arranged on both slides of the middle support 51, and have bores 65, 66 for the fastening screws 34, 35. In the middle portion, the guide element 50 is arched and forms a hollow space 67 for the rotor 5. On both sides of the middle support 51, guide slots 68, 69 are made in the side parts 52 and 53. These serve to guide the contact elements 55.

The operation of the lock shown in FIG. 5 may be explained as follows. As shown in FIG. 6, the contact points 8 on the key 2 are arranged on its narrow sides 20 and 21. The contact points 8 are symmetrically designed on both narrow sides 20, 21, and in the same way connected through the electrical conductors 12 with the electronic element 9 in the key 2. In the portion of the contact device, there is formed on the rotor 5 a ring groove 18 by which a ring gap 18 results in this portion between the rotor 5, the stator housing 3 and the guide element 50. In the upper portion of this ring groove 18 are positioned the spring portions 62 of the slide spring elements 57, 58. Their position is determined, on the one hand, by the fastening of the connection part 56 in the bearing or conductor plate 14, and on the other hand by the forced guiding of the ends 63 in the guide slots 68, 69. The slide spring elements 57, 58 form on both sides of the connection part 56 or of the key channel 6 in the pull-out position, tangents to an outer diameter of the rotor 5, while they are arranged free of contact with the mantle of the rotor 5. Between the bottom 19 of the groove on the rotor 5 and the two spring portions 62 of the slide springs 57, 58, there is thus an interspace. The dimensions of the contact part 12 with the contact points 8 on the key barb 7 and the groove 18 on the rotor 5 are so chosen that the narrow side 20 of the contact part 12 stands out above the bottom 19 of the groove. This projection is so dimensioned that, in the example shown, the contact points 8 on the narrow side 20, with the rotation representative of the rotor 5, touch the spring portion 62 of the slide spring 58 and deflect this latter from its rest position until the desired contact force is reached. In this way, the electric connection is made between the electronic elements 9, 41 in the lock 1 and in the key 2, and data can be transmitted so long as the contact points 8 are connected with one of the slide springs 57, 58 of a contact element 55.

The two examples of execution of the lock 1, shown in FIGS. 1 to 4 and in 5 to 8, both have the following advantages. The construction according to the invention makes possible the premounting of the contact element 15 or 55 on the bearing or conductor plate 14. In the example according to FIGS. 1 to 4, the guide element 16, in common with the bearing plate 14 and the contact element 15, is set radially into the stator housing 3 and fastened. In the example according to FIGS. 5 to 8, the guide element 50 and the bearing plate 14 with the contact element 55 are set radially, in succession, into the stator housing 3 and fastened. Independent of the installation of the electric parts and the contact elements, the whole mechanical portion of the cylinder lock 1, in both examples of execution can be fully mounted and tested in advance. In this way, the production process of such locks is greatly simplified since the electric parts can also be tested independently of the mechanical parts. A further improvement of the contacting between the contact elements 15, 55 and the contact points 8 on the key barb 7 is attained by the dividing of the slide springs 27, 28 or 57, 58 into two parts movably independently of each other. This arrangement makes possible a reduction of the rate of failures in the amount of the second power. Since the contact elements 15, or 55 are only introduced from outside to the rotating part of the rotor 5 and of the key 2, the installation and removal of the guide element 16 or 50 with the bearing or conductor part 14 and the contact elements 15 or 55 can take place without disturbing the mechanical portion of the cylinder lock 1. To assure this accessibility, the slide spring elements 27, 28 or 57, 58 extend, at a maximum, 90° on either side of the pull-out position of the key channel 6 in the cylinder lock 1.

Having described preferred embodiments of the invention, the following is claimed:

1. A contact device for the transmission of electric signals between a lock and key in a cylinder lock with a stator housing, a rotor arranged in said housing with mechanical holding devices, and a key channel within said rotor having a portion with contact elements for the transmission of signals, a key with an integrated electronic information carrier on a portion of the key barb having contact points being arranged beside mechanical codings, said key being insertable in said key channel and turnable together with said rotor, all the elements of said lock being arranged around an axis of said key channel in said rotor and being enclosed by a cylindrical protective sheath, with the distinction that on said stator housing (3) in the portion of contact elements (15, 55) a segment of a mantle (45) is cut out, said cut-out (45) leaving free a portion of said mantle of said rotor (5), the portion of said key channel (6) serving to receive the key barb portion (12) with said contact points (8) into said opening (45) of said stator housing (3), within said protective sheath (11) being arranged a guide element (16, 50) of electric insulation material for said mechanical contact elements (15, 55) fastened to a bearing plate (14), said contact elements (15, 55) engaging in said guide element (15, 50) and including pairs of slide springs (27, 28 or 57, 58), said spring elements (27, 28 or 57, 58) in the freed portion of said rotor mantle each being placed on each side tangent to the rotor mantle and free of contact with the latter, said bearing plate (14) with said contact elements (15, 55) and said guide elements (16, 50) being set radially into said stator opening (45) and enclosed by said protective sheath (11).

2. The contact device according to claim 1, with the distinction that said spring elements (27, 28 or 57, 58) of said contact elements (15, 55) are separated in the middle portion and have two contact points.

3. The contact device according to claim 1, with the distinction that said slide springs (27, 28 or 57, 58) are arranged in the portion of a maximum of 90° on both sides of the pull-out position of said key channel (6).

4. A contact device for the transmission of electric signals between a lock and key in a cylinder lock with a stator housing, a rotor arranged in said housing with mechanical holding devices, and with a key channel having a portion with contact elements for the transmission of signals, a key with an integrated electronic information carrier on a portion of the key barb having contact points being arranged beside mechanical codings, all the elements of said lock being enclosed by a cylindrical protective sheath, with the distinction that on said stator housing (3) in the portion of contact elements (15, 55) a segment of a mantle (45) is cut out, said cut-out (45) leaving free a portion of said mantle of said rotor (5), the portion of said key channel (6) serving to receive the key barb portion (12) with said contact points (8) into said opening (45) of said stator housing (3), within said protective sheath (11) being arranged a guide element (16, 50) of electric insulation material for said mechanical contact elements (15, 55) fastened to a bearing plate (14), said contact elements (15, 55) engaging in said guide element (15, 50) and including pairs of slide springs (27, 28 or 57, 58), said spring elements (27, 28 or 57, 58) in the freed portion of said rotor mantle each being placed on each side tangent to the rotor mantle and free of contact with the latter, said bearing plate (14) with said contact elements (15, 55) and said guide elements (16, 50) being set radially into said stator opening (45) and enclosed by said protective sheath (11), said bearing plate (14) being made from a reinforced conductor plate, and connection parts (26, 56) of said contact elements (15, 55) being connected by conductors (25) on said plate (14).

5. A contact device for the transmission of electric signals between a lock and key in a cylinder lock with a stator housing, a rotor arranged in said housing with mechanical holding devices, and with a key channel having a portion with contact elements for the transmission of signals, a key with an integrated electronic information carrier on a portion of the key barb having contact points being arranged beside mechanical codings, all the elements of said lock being enclosed by a cylindrical protective sheath, with the distinction that on said stator housing (3) in the portion of contact elements (15, 55) a segment of a mantle (45) is cut out, said cut-out (45) leaving free a portion of said mantle of said rotor (5), the portion of said key channel (6) serving to receive the key barb portion (12) with said contact points (8) into said opening (45) of said stator housing (3), within said protective sheath (11) being arranged a guide element (16, 50) of electric insulation material for said mechanical contact elements (15, 55) fastened to a bearing plate (14), said contact elements (15, 55) engaging in said guide element (15, 50) and including pairs of slide springs (27, 28 or 57, 58), said spring elements (27, 28 or 57, 58) in the freed portion of said rotor mantle each being placed on each side tangent to the rotor mantle and free of contact with the latter, said bearing plate (14) with said contact elements (15, 55) and said guide elements (16, 50) being set radially into said stator opening (45) and enclosed by said protective sheath (11), said rotor (5) in the portion of said slide spring elements (27, 28 or 57, 58) has on its outer mantle at least one ring groove (18), and an interspace between said slide spring elements (27, 28 or 57, 58) and the bottom (19) of said groove.

6. The contact device according to claim 5, with the distinction that, with key (2) inserted fully into said key channel (6) of said rotor (5), one narrow side with said contact points (8) of said key stands out above the bottom (19) of said groove on said rotor (5), and during a part of the rotation of said rotor (5) touches said slide spring elements (27, 28 or 57, 58).

7. A contact device for the transmission of electric signals between a lock and key in a cylinder lock with a stator housing, a rotor arranged in said housing with mechanical holding devices, and with a key channel having a portion with contact elements for the transmission of signals, a key with an integrated electronic information carrier on a portion of the key barb having contact points being arranged beside mechanical codings, all the elements of said lock being enclosed by a cylindrical protective sheath, with the distinction that on said stator housing (3) in the portion of contact elements (15, 55) a segment of a mantle (45) is cut out, said cut-out (45) leaving free a portion of said mantle of said rotor (5), the portion of said key channel (6) serving to receive the key barb portion (12) with said contact points (8) into said opening (45) of said stator housing (3), within said protective sheath (11) being arranged a guide element (16, 50) of electric insulation material for said mechanical contact elements (15, 55) fastened to a bearing plate (14), said contact elements (15, 55) engaging in said guide element (15, 50) and including pairs of slide springs (27, 28 or 57, 58), said spring elements (27, 28 or 57, 58) in the freed portion of said rotor mantle each being placed on each side tangent to the rotor mantle and free of contact with the latter, said bearing plate (14) with said contact elements (15, 55) and said guide elements (16, 50) being set radially into said stator opening (45) and enclosed by said protective sheath (11), a microswitch (42) being arranged on said bearing plate (14), said microswitch (42) being switched into the electric current circuit and has, as switching element, a switch pin (43) of which the end projects into said key channel (6).

8. The contact device according to claim 7, with the distinction that said microswitch (42) includes a foil key (44) which is integrated into said conductor plate (14).

9. The contact device according to claim 7, with the distinction that said switch pin (43) of said microswitch (42) in the zone of the rear three-fourths of the length of the key barb (7) extending from the beginning of the contact part (12) to the end of the key, cooperates with said key (2).

10. A contact device for the transmission of electric signals between a lock and key in a cylinder lock with a stator housing, a rotor arranged in said housing with mechanical holding devices, and with a key channel having a portion with contact elements for the transmission of signals, a key with an integrated electronic information carrier on a portion of the key barb having contact points being arranged beside mechanical codings, all the elements of said lock being enclosed by a cylindrical protective sheath, with the distinction that on said stator housing (3) in the portion of contact elements (15, 55) a segment of a mantle (45) is cut out, said cut-out (45) leaving free a portion of said mantle of said rotor (5), the portion of said key channel (6) serving to receive the key barb portion (12) with said contact points (8) into said opening (45) of said stator housing (3), within said protective sheath (11) being arranged a guide element (16, 50) of electric insulation material for said mechanical contact elements (15, 55) fastened to a bearing plate (14), said contact elements (15, 55) engaging in said guide element (15, 50) and including pairs of slide springs (27, 28 or 57, 58), said spring elements (27, 28 or 57, 58) in the freed portion of said rotor mantle each being placed on each side tangent to the rotor mantle and free of contact with the latter, said bearing plate (14) with said contact elements (15, 55) and said guide elements (16, 50) being set radially into said stator opening (45) and enclosed by said protective sheath (11), said two support surfaces (32, 33) between said stator housing (3) and said guide element (16) being arranged on said stator housing (3) and/or on said guide element (16), parallel guide grooves (31) running perpendicular to the axis (17) of said lock, and the free ends (29, 30) of said slide spring elements (27, 28) of said contact elements (15) being supported movable in said grooves (31).

11. The contact device according to claim 10, with the distinction that said free ends (29, 30) of said slide spring elements (27, 28) of said contact elements (15) are provided with an electric insulation layer (39, 40).

12. A contact device for the transmission of electric signals between a lock and key in a cylinder lock with a stator housing, a rotor arranged in said housing with mechanical holding devices, and with a key channel having a portion with contact elements for the transmission of signals, a key with an integrated electronic information carrier on a portion of the key barb having contact points being arranged beside mechanical codings, all the elements of said lock being enclosed by a cylindrical protective sheath, with the distinction that on said stator housing (3) in the portion of contact elements (15, 55) a segment of a mantle (45) is cut out, said cut-out (45) leaving free a portion of said mantle of said rotor (5), the portion of said key channel (6) serving to receive the key barb portion (12) with said contact points (8) into said opening (45) of said stator housing (3), within said protective sheath (11) being arranged a guide element (16, 50) of electric insulation material for said mechanical contact elements (15, 55) fastened to a bearing plate (14), said contact elements (15, 55) engaging in said guide element (15, 50) and including pairs of slide springs (27, 28 or 57, 58), said spring elements (27, 28 or 57, 58) in the freed portion of said rotor mantle each being placed on each side tangent to the rotor mantle and free of contact with the latter, said bearing plate (14) with said contact elements (15, 55) and said guide elements (16, 50) being set radially into said stator opening (45) and enclosed by said protective sheath (11), said contact elements (55) in the portion of the axis (46) of said lock having a connection part (56), said two slide spring elements (57, 58) starting from said connection part (56) being bent back into the portion (59, 60) away from said connection part (56), and each is formed to two spring portions (61, 62) running parallel, said spring portion (62) by the free spring element end (63) being directed toward said rotor (5) and being arranged free of contact with said rotor (5), and the free end (63) of each slide spring element (57, 58) being supported against a middle support (51) of said guide element (50).

13. A contact device for the transmission of electrical signals between a cylinder lock and a key, the lock including a stator housing and a rotor arranged in the stator housing with mechanical holding devices, the rotor having a mantle and the stator housing having a mantle in which a segment of the mantle of the stator housing is cut out to form a stator opening leaving free a portion of the rotor mantle, a key channel being defined in the rotor, the key including a key barb having an integrated electronic information carrier arranged on a portion of the key barb and having contact points arranged beside mechanical codings, the key being insertable in the key channel and turnable with the rotor, elements of the lock being arranged around an axis of the key channel in the rotor and being enclosed by a cylindrical protective sheath, the contact device comprising:

a bearing plate;

a guide element made of electrically insulated material and arranged within the protective sheath; and mechanical contact elements fastened to the bearing plate and in the guide element, the contact elements including pairs of slide spring elements in the freed portion of the rotor mantle, each of the spring elements in the freed portion of the rotor mantle being placed on each side tangent to the rotor mantle and free of contact with the latter, the bearing plate with the contact elements and the guide elements being set radially into the stator opening and enclosed by the protective sheath.

* * * * *